United States Patent [19]

Kato

[11] Patent Number: 4,893,373

[45] Date of Patent: Jan. 16, 1990

[54] MANUAL WIPER

[75] Inventor: Makoto Kato, Tokyo, Japan

[73] Assignee: Yugen Kaisha Ads. Planning, Tokyo, Japan

[21] Appl. No.: 270,257

[22] Filed: Nov. 14, 1988

[51] Int. Cl.[4] ..... A47L 25/00

[52] U.S. Cl. ..... 15/245; 15/227

[58] Field of Search ..... 15/227, 245, 236.01

[56] References Cited

U.S. PATENT DOCUMENTS

| | | | |
|---|---|---|---|
| 4,787,113 | 11/1988 | Kamenske | 15/227 |
| 4,823,426 | 4/1989 | Bragga | 15/227 |
| 4,827,557 | 5/1989 | Siler, Jr. et al. | 15/245 |

FOREIGN PATENT DOCUMENTS

| | | | |
|---|---|---|---|
| 1597837 | 9/1981 | United Kingdom | 15/227 |

*Primary Examiner*—Edward L. Roberts

*Attorney, Agent, or Firm*—Cushman, Darby & Cushman

[57] ABSTRACT

A manual wiper comprises an elastic base detachably wound around a finger and a wiper blade which is provided on the base in such a manner as to traverse the same and whose position is adjustable. The wiper is adapted to be attached to a finger so as to remove waterdrops if one hand with the wiper blade attached to one finger is used to rub the window plate to which waterdrops have adhered.

3 Claims, 2 Drawing Sheets

MANUAL WIPER

BACKGROUND OF THE INVENTION

1. Field of the Invention

The present invention relates to a manual wiper, and more particularly to a manual wiper arranged to be capable of removing waterdrops or stains adhering to a window portion of a helmet, goggles, or the like.

2. Statement of the Related Art

The front windshield of an automobile is provided on its outer side with a wiper for removing waterdrops and stains.

A wiper of this type has a structure in which a wire blade formed of a resilient material such as rubber or the like and having a predetermined length is secured to a distal end portion of an arm which swings back and forth in such a manner as to wipe a fixed fan-shaped area under the driving force of a motor, and this wiper blade is pressed against the outside surface of the front glass to remove waterdrops and stains.

The component parts of such a wire apparatus, including the wire motor, are relatively large, so that the overall wiper apparatus is inevitably large in size.

It is often mandatory to wear a helmet and goggles when one rides a motorcycle, and if one rides a motorcycle wearing such headgear in rainy weather, waterdrops adhere to the window plates provided in the headgear. However, since wiper apparatus are large in size, it is virtually impossible to install one on a helmet or the like. Even if a compact wiper apparatus were to be produced incorporating a battery, if the wiper were fixed to the window plate of a helmet, the wiper would itself become an obstruction.

For this reason, waterdrops adhering to a window plate are conventionally removed by using a towel or the like, but it has not been possible to thereby remove waterdrops as efficiently as with a wiper, and the use of towels for this purpose is very inconvenient.

SUMMARY OF THE INVENTION

Accordingly, an object of the present invention is to provide a manual wiper which is capable of positively removing waterdrops or the like adhering to a window plate of a helmet or the like, thereby overcoming the above-described drawbacks of the conventional art.

To this end, a manual wiper according to the present comprises: an elastic base detachably wound around a finger; and a wiper blade which is provided on the base in such a manner as to traverse the same and whose position is adjustable.

If the above-described arrangement is adopted, since the wiper is adapted to be attached to a finger, the wiper does not constitute a hindrance during riding of a motorcycle, and it is possible to remove waterdrops in the same way as a conventional wiper does if one hand with the wiper blade attached to one finger is used to rub the window plate to which waterdrops have adhered.

The above and other objects, features and advantages of the present invention will become more apparent from the following detailed description of the invention when read in conjunction with the accompanying drawings.

BRIEF DESCRIPTION OF THE DRAWINGS

The drawings illustrate a manual wiper in accordance with an embodiment of the present invention, in which.

DESCRIPTION OF THE PREFERRED EMBODIMENT

Figure 1:
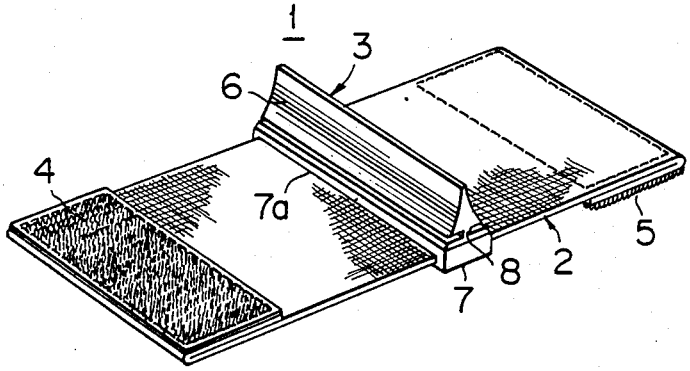
FIG. 1 is an overall perspective view.

Referring now to the accompanying drawings, a detailed description will be given of the present invention.

FIGS. 1 to 4 illustrate an embodiment of a manual wiper 1 in accordance with the present invention. The manual wiper 1 comprises an elastic base 2 and a wiper blade 3.

As for the base 2, a material such as cloth or a plastic sheet which is flexible and elastic is used. The length of the base 2 is such as to allow the base cloth 2 to be sufficiently wound around a finger, and its width is about equal to the length of the forefinger from the tip In addition, an engaging member 4 such as a helmet fastener is fixed on an upper surface of this base 2 at one end portion thereof across the entire width thereof, while an engaging member 5 for engaging detachably with the engaging member 4 is secured on a lower surface at the other end thereof. These engaging members 4, 5 have mutually engageable configurations.

The wiper blade 3 is formed of a resilient material such as rubber or a soft plastic, and includes a blade portion 6 and a base portion 7. The blade portion 6 has a length substantially identical with the width of the base 2, and has a section with a substantially triangular shape which is pointed at the distal end.

The base portion 7 is formed into an elongated planar shape having substantially the same width as that of the proximal end of the blade 6 and has a large thickness. Its length is longer than the width of the base 2 and has a flat opening 7*a* which allows the base 2 to pass therethrough in a transversely penetrating state. The vertical width of the opening 7*a* is slightly smaller than the thickness of the base 2, and exerts a large frictional force on the relative movement of the base 2 and the base portion 7.

The base portion 7 is formed of a hard synthetic resin, and may be integrated with the blade portion 6 with an adhesive.

The base portion 7 and the blade portion 6 are integrally connected by means of a thin connecting portion 8 over the entire length thereof. The arrangement is such that, since this portion is subjected to elastic deformation, the overall blade portion 6 is also subjected to elastic deformation toward the left and right as viewed in FIG. 1, and the distal end of the blade portion 6 is brought into close contact with the window plate of the helmet.

A description will now be given of a method of using the manual wiper thus constructed in accordance with the present invention.

Figure 2:
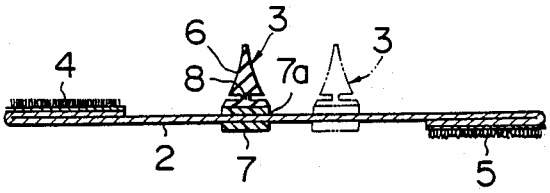
FIG. 2 is a longitudinal cross-sectional view.

First, as shown in FIG. 2, the wiper blade is moved relative to the base 2 to determine an optimum position of the wiper blade 3.

Figure 3:
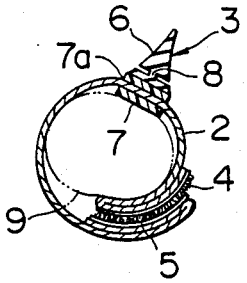
FIG. 3 is a longitudinal cross-sectional view of a state in which the manual wiper is attached to a finger.

In this state, as shown in FIG. 3, the base 2 is wound around a finger (e.g., a forefinger) 9 while being stretched, and the overall wiper blade 3 is set in such a manner as to be inclined toward the user's face. The engaging members 4, 5 are superposed on each other so as to be engaged. Thus, the wiper blade 3 is set on the finger via the base 2.

The rider travels with the wiper blade on his finger in this state, but since the base 2 and the wiper blade 3 is capable of undergoing elastic deformation, no hindrance is caused during riding even when holding and maneuvering the handle bar.

Figure 4:
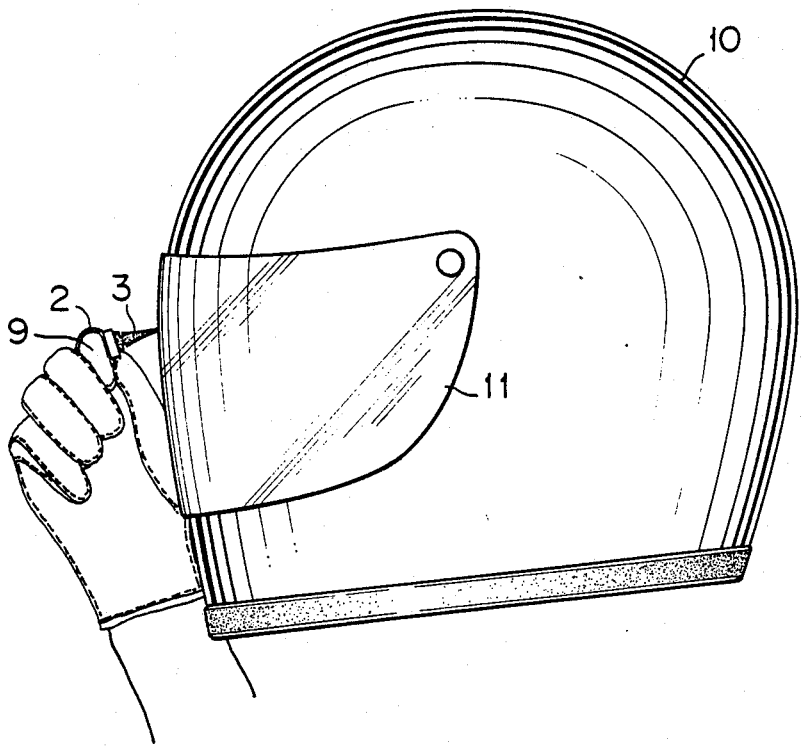
FIG. 4 is a diagram illustrating the state of use of the manual wiper.

If, in rainy weather, the hand on which the wiper blade 3 is attached is released from the handle bar, and the distal end of the wiper blade 3 is pressed against a window plate 11 of a helmet 10, as shown in FIG. 4, the window plate 11 can be rubbed vertically with the wiper blade 3 pressed against the window plate 11 while undergoing elastic deformation, and and the rider is able to remove waterdrops adhering to the window plate 11, thereby ensuring good visibility.

It should be noted that although FIG. 4 illustrates a case where the manual wiper is attached over a glove, it goes without saying that the manual wiper may also be worn on bare hands.

In addition, the manual wiper may be attached to any finger, not only to a forefinger, so long as it is easy to use the wiper. The manual wiper may, of course, be attached to a finger of either the left of right hand.

As described above, in accordance with the present invention, since the structure adopted is one in which a wiper blade is slidably provided on an elastic base detachably wound around a finger, when waterdrops or stains adhere to a window plate of a helmet or the like, if the hand is released from the handle bar and the wiper blade is pressed and rubbed against the window plate, the waterdrops or stains can be removed positively and deliberately.

What is claimed is:

1. A manual wiper comprising:

an elastic base elongated adopted to be detachably wound around a finger; and a wiper blade provided on said base in such a manner as to traverse the same and whose position is adjustable on said base.

2. A manual wiper according to claim 1, wherein said base is formed of a flexible material and has a length and a width which are sufficient to allow said base to be wound around a finger, a pair of engaging members are secured to an upper surface at one end thereof and on a lower surface at the other end thereof, respectively, said engaging members have mutually engageable configurations, said wiper blade includes a blade portion formed of a resilient material and a base portion, said blade portion has a length substantially identical with the width of said base and has a section formed into a triangular shape whose distal end is pointed, and said base portion is formed into an elongated planar shape having a length greater than the width of said base and is provided with a flat opening through which said base is slidably fitted.

3. A manual wiper according to claim 2, wherein said base portion 7 is formed of a hard synthetic resin and is integrated with said blade portion by bonding.

* * * * *